US011249415B2

(12) United States Patent
Shimizu et al.

(10) Patent No.: US 11,249,415 B2
(45) Date of Patent: Feb. 15, 2022

(54) IMAGE FORMING APPARATUS USING TWO-COMPONENT DEVELOPER INCLUDING TONER AND CARRIER THAT DETERMINES TONER CHARGE AMOUNT BASED ON A DEVELOPING CURRENT

(71) Applicant: KYOCERA Document Solutions Inc., Osaka (JP)

(72) Inventors: Tamotsu Shimizu, Osaka (JP); Takahiro Okubo, Osaka (JP); Yohei Wakasa, Osaka (JP); Kazuhiro Nakachi, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 17/098,405

(22) Filed: Nov. 15, 2020

(65) Prior Publication Data

US 2021/0149320 A1 May 20, 2021

(30) Foreign Application Priority Data

Nov. 15, 2019 (JP) ..... JP2019-206952

(51) Int. Cl.
*G03G 15/06* (2006.01)
*G03G 15/00* (2006.01)

(52) U.S. Cl.
CPC ..... *G03G 15/065* (2013.01); *G03G 15/556* (2013.01)

(58) Field of Classification Search
CPC ..... G03G 15/556
See application file for complete search history.

(56) References Cited

U.S. PATENT DOCUMENTS

2003/0219266 A1 11/2003 Itagaki et al.
2007/0134012 A1* 6/2007 Suzuki ..... G03G 15/50 399/49
2019/0129328 A1* 5/2019 Watanabe ..... G03G 15/5041

FOREIGN PATENT DOCUMENTS

JP 2003-345075 A 12/2003
JP 2009-294504 A 12/2009
JP 2010-019969 A 1/2010

* cited by examiner

*Primary Examiner* — Victor Verbitsky
(74) *Attorney, Agent, or Firm* — Hawaii Patent Services; Nathaniel K. Fedde; Kenton N. Fedde

(57) ABSTRACT

Provided is an image forming apparatus having a simple configuration capable of measuring a toner current included in a developing current and accurately calculating a toner charge amount based on the measurement result. The developing device has a developer carrier that carries a two-component developer including a magnetic carrier and toner. The density detecting device detects the density of the toner image. The current detecting unit detects a DC component of a developing current that flows when a developing voltage is applied to the developer carrier. The control unit, in a state in which the image carrier is rotated at two or more different linear speeds during non-image formation, forms the same reference image on the image carrier by the developing device, and estimates the toner charge amount based on the developing current when the reference image is formed and the density of the reference image.

5 Claims, 4 Drawing Sheets

IMAGE FORMING APPARATUS USING TWO-COMPONENT DEVELOPER INCLUDING TONER AND CARRIER THAT DETERMINES TONER CHARGE AMOUNT BASED ON A DEVELOPING CURRENT

INCORPORATION BY REFERENCE

This application is based on and claims the benefit of priority from Japanese Patent Application No. 2019-206952 filed on Nov. 15, 2019, the contents of which are hereby incorporated by reference.

BACKGROUND

In a developing method using a two-component developer including a magnetic carrier and toner, the developer is affected by the number of prints, environmental (temperature and humidity) fluctuations, print mode, print rate on the image (ratio of the area to be printed to the area where an image can be formed) and the like and deteriorates, and the charging characteristics of the toner in the developer change. As a result, the toner cannot be sufficiently charged, and problems such as a decrease in image density, image fogging, toner scattering and the like occur.

Therefore, conventionally, a change in the amount of toner charged is predicted based on the number of prints, environmental changes, printing modes, printing rates, and the like. Then, based on the prediction result, the toner density, the developing voltage, the surface potential of the photoconductor, the rotation speed of the developing roller, the output of the fan that sucks the scattered toner, and the like are adjusted to suppress a reduction in the image density, and suppress image fogging, and toner scattering.

However, these methods are merely a combination of prediction from the number of prints, and prediction under each condition of environmental change, print mode, and print rate, and in a case where the number of prints, environmental fluctuation, print mode, print rate, and the like is changed in a complex manner, the amount of charge of the toner may not be predicted accurately.

Therefore, a method of directly calculating the toner charge amount has been proposed. For example, in a typical technique, there is an image forming apparatus in which the surface potential of the drum before development and the surface potential of the toner layer after development are measured, the toner developing amount is obtained from the image density measurement of the toner layer, and the toner developing amount is found from the surface potentials of the drum and toner layer and the toner charge amount.

Moreover, in another typical technique there is an image forming apparatus capable of executing a first mode and a second mode. In the first mode, a toner image is formed based on image data for printing. In the second mode, a patch image is formed based on patch image data, and the charge amount of the toner is measured based on the density of the patch image and the developing current. Furthermore, in another typical technique, the amount of adhesion of the image formed on the image carrier is changed. Together with this, there is an image forming apparatus that calculates the toner charge amount based on the amount of change in the developing current detected by a current detecting means and the amount of change in the amount of adhesion of the developer detected by an adhering amount detecting means according to the change in the image formed on the image carrier.

SUMMARY

In order to accomplish the object described above, a first configuration according to the present disclosure is an image forming apparatus that includes: an image forming unit that includes an image carrier, a charging device, an exposing device, and a developing device; a developing voltage power supply; a density detecting device; a current detecting unit; and a control unit. A photosensitive layer is formed on the surface of the image carrier. The charging device charges the image carrier. An exposing device forms an electrostatic latent image by exposing the image carrier charged by the charging device. The developing device has a developer carrier arranged facing the image carrier and carrying a two-component developer that includes a magnetic carrier and toner, and forms a toner image by adhering the toner to the electrostatic latent image formed on the image carrier. The developing voltage power supply applies a developing voltage obtained by superimposing an AC voltage on a DC voltage on the developer carrier. The density detecting device detects the density of the toner image formed by the developing device. The current detecting unit detects a DC component of a developing current that flows when a developing voltage is applied to the developer carrier. The control unit controls the image forming unit and the developing voltage power supply. The control unit, in a state in which the image carrier is rotated at two or more different linear speeds during non-image formation, forms the same reference image on the image carrier by the developing device, and estimates the toner charge amount based on the developing current when the reference image is formed and the density of the reference image detected by the density detecting device.

DETAILED DESCRIPTION

Figure 1:
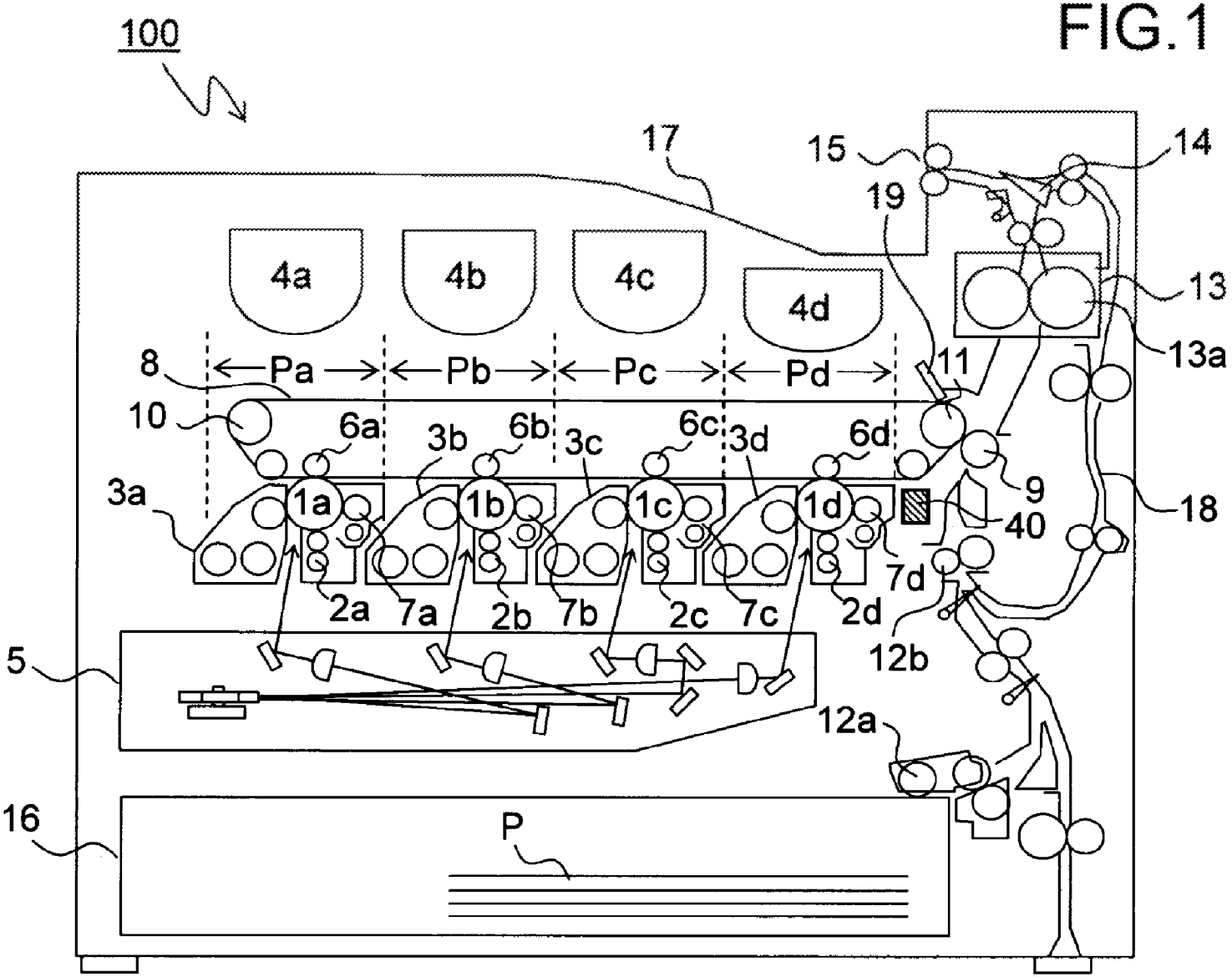
FIG. 1 is a side cross-sectional view illustrating an internal configuration of an image forming apparatus 100 of an embodiment according to the present disclosure.

Hereinafter, embodiments according to the present disclosure will be described with reference to the drawings. FIG. 1 is a cross-sectional view illustrating an internal configuration of an image forming apparatus 100 of an embodiment according to the present disclosure. In the main body of the image forming apparatus 100 (a color printer in this case), four image forming units Pa, Pb, Pc and Pd are arranged in order from the upstream side in the conveying direction (left side in FIG. 1). These image forming units Pa to Pd are provided so as to correspond to images of four different colors (cyan, magenta, yellow, and black), and through each step of charging, exposing, developing and transferring, the image forming units Pa to Pd sequentially form cyan, magenta, yellow, and black images, respectively.

Photoconductor drums (image carriers) 1*a*, 1*b*, 1*c* and 1*d* that carry visible images (toner images) of each color are arranged in these image forming units Pa to Pd. Furthermore, an intermediate transfer belt (intermediate transfer body) 8 that is rotated in the counterclockwise direction in FIG. 1 by a drive unit is provided adjacent to each of the image forming units Pa to Pd. The toner images formed on the photoconductor drums 1*a* to 1*d* are primarily transferred and superimposed sequentially on the intermediate transfer belt 8 that moves while coming in contact with each of the photoconductor drums 1*a* to 1*d*. After that, the toner images that have been primarily transferred onto the intermediate transfer belt 8 are secondarily transferred by a secondary transfer roller 9 onto transfer paper P as an example of a recording medium. Furthermore, the transfer paper P on which the toner images have been secondarily transferred is discharged from the main body of the image forming apparatus 100 after the toner images are fixed by a fixing unit 13. An image forming process for each of the photoconductor drums 1*a* to 1*d* is executed while rotating the photoconductor drums 1*a* to 1*d* in the clockwise direction in FIG. 1.

The transfer paper P on which the toner images will be secondarily transferred is housed in a paper cassette 16 arranged in the lower part of the main body of the image forming apparatus 100. Moreover, the transfer paper P is conveyed via a paper supply roller 12*a* and a registration roller pair 12*b* to a nipping part between the secondary transfer roller 9 and the drive roller 11 of the intermediate transfer belt 8. A sheet made of a dielectric resin is used for the intermediate transfer belt 8, and a belt having no seams (seamless) is mainly used. Moreover, a blade-shaped belt cleaner 19 for removing toner and the like remaining on the surface of the intermediate transfer belt 8 is arranged on the downstream side of the secondary transfer roller 9.

Next, the image forming units Pa to Pd will be described. Charging devices 2*a*, 2*b*, 2*c* and 2*d*, an exposing device 5, developing devices 3*a*, 3*b*, 3*c* and 3*d*, and cleaning devices 7*a*, 7*b*, 7*c* and 7*d* are provided around and below the rotatably arranged photoconductor drums 1*a* to 1*d*. The charging devices 2*a*, 2*b*, 2*c* and 2*d* charge the photoconductor drums 1*a* to 1*d*. The exposing device 5 exposes image information on the photoconductor drums 1*a* to 1*d*. The developing devices 3*a*, 3*b*, 3*c* and 3*d* form toner images on the photoconductor drums 1*a* to 1*d*. The cleaning devices 7*a*, 7*b*, 7*c* and 7*d* remove developer (toner) and the like remaining on the photoconductor drums 1*a* to 1*d*.

When image data is inputted from a host apparatus such as a personal computer or the like, first, the surfaces of the photoconductor drums 1*a* to 1*d* are uniformly charged by the charging devices 2*a* to 2*d*. Next, the exposing device 5 irradiates light according to the image data to form electrostatic latent images corresponding to image data on the photoconductor drums 1*a* to 1*d*. The developing devices 3*a* to 3*d* are filled with a specific amount of a two-component developer including each color toner of cyan, magenta, yellow, and black, respectively. Note that in a case where the ratio of toner in the two-component developer that is filled in each of the developing devices 3*a* to 3*d* falls below a specified value due to the formation of the toner images described later, toner is supplied to each of the developing devices 3*a* to 3*d* from toner containers 4*a* to 4*d*. The toner in the developer is supplied onto the photoconductor drums 1*a* to 1*d* by the developing devices 3*a* to 3*d*, and toner images corresponding to the electrostatic latent images formed by exposure from the exposing device 5 are formed by toner electrostatically adhering to the photoconductor drums 1*a* to 1*d*.

Then, an electric field is applied between primary transfer rollers 6*a* to 6*d* and the photoconductor drums 1*a* to 1*d* at a specific transfer voltage by the primary transfer rollers 6*a* to 6*d*, and cyan, magenta, yellow and black toner images on the photoconductor drums 1*a* to 1*d* are primarily transferred onto the intermediate transfer belt 8. These four-color images are formed with a specific positional relationship specified in advance for the formation of a specific full-color image. After that, in preparation for the subsequent formation of new electrostatic latent images, the toner and the like remaining on the surfaces of the photoconductor drums 1*a* to 1*d* after the primary transfer are removed by the cleaning devices 7*a* to 7*d*.

The intermediate transfer belt 8 is suspended around a driven roller 10 on the upstream side and the drive roller 11 on the downstream side. Then, as the drive roller 11 is rotated by a drive motor, the intermediate transfer belt 8 starts rotating in the counterclockwise direction. Then, the transfer paper P is conveyed at a specific timing from the registration roller pair 12*b* to the nipping part (secondary transfer nipping part) between the drive roller 11 and the adjacently provided secondary transfer roller 9. Then, the full-color image on the intermediate transfer belt 8 is secondarily transferred onto the transfer paper P. The transfer paper P on which the toner image is secondarily transferred is conveyed to a fixing unit 13.

The transfer paper P conveyed to the fixing unit 13 is heated and pressurized by a fixing roller pair 13*a* to fix the toner image on the surface of the transfer paper P, and a specific full-color image is formed. The transfer paper P on which the full-color image is formed is distributed in the conveying direction by branching portions 14 branched in a plurality of directions, and then is discharged as is (or after being sent to a double-sided conveying path 18 and an image is formed on both sides) to a discharge tray 17 by a discharge roller pair 15.

Furthermore, an image density sensor 40 is arranged at a position facing the drive roller 11 with the intermediate transfer belt 8 interposed therebetween. As the image density sensor 40, an optical sensor including a light emitting element made of an LED or the like and a light receiving element made of a photodiode or the like are generally used. When measuring the amount of toner adhering on the intermediate transfer belt 8, a measurement light is irradiated from a light emitting element onto each reference image formed on the intermediate transfer belt 8, and that measurement light enters into a light receiving element as light that is reflected by the toner and light that is reflected by the belt surface.

The reflected light from the toner and the belt surface includes specularly reflected light and diffusely reflected light. The specularly reflected light and the diffusely reflected light are separated by a polarized light separating prism and then enters into separate light receiving elements, respectively. Each light receiving element photoelectrically converts the specularly reflected light and the diffusely reflected light that is received and outputs an output signal to a main control unit 80 (see FIG. 3). Then, the toner amount is detected from the characteristic change of the output signals of the specularly reflected light and the diffusely reflected light, and density correction (calibration) is performed for each color by adjusting the characteristic value of the developing voltage or the like in comparison with a reference density that is specified in advance.

Figure 2:
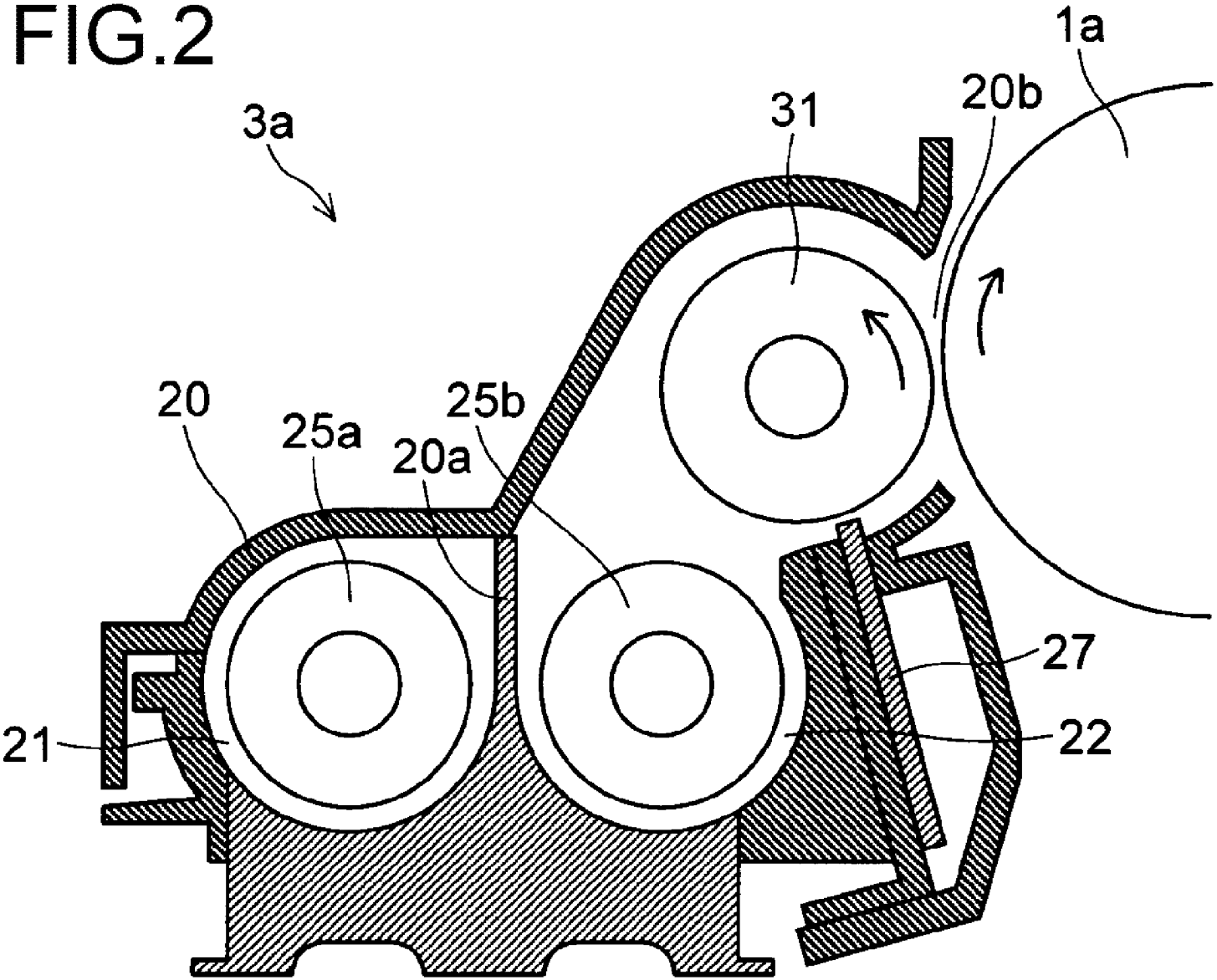
FIG. 2 is a side cross-sectional view of a developing device 3*a* mounted in an image forming apparatus 100.

FIG. 2 is a side cross-sectional view of a developing device 3*a* mounted in the image forming apparatus 100. Note that in the following description, an example of a developing device 3*a* arranged in the image forming unit Pa of FIG. 1 is illustrated; however, the configuration of the developing devices 3*b* to 3*d* arranged in the image forming units Pb to Pd is basically the same, so a description is omitted.

As illustrated in FIG. 2, the developing device 3*a* includes a developing container 20 in which a two-component developer that includes a magnetic carrier and toner (hereinafter, simply referred to as a developer) is stored, and the developing container 20 is divided by a partition wall 20*a* into a stirring conveying chamber 21 and a supply conveying chamber 22. In the stirring conveying chamber 21 and the supply conveying chamber 22, a stirring conveyor screw 25*a* and a supply conveyor screw 25*b* for mixing, stirring and charging the toner supplied from the toner container 4*a* (see FIG. 1) with a magnetic carrier are rotatably arranged, respectively.

Then, the developer is conveyed in the axial direction (direction perpendicular to the paper surface of FIG. 2) while being stirred by the stirring conveyor screw 25*a* and the supply transfer screw 25*b*, and circulates between the stirring conveying chamber 21 and the supply conveying chamber 22 via developer passage paths formed at both end portions of the partition wall 20*a*. In other words, a circulation path for the developer is formed in the developing container 20 by the stirring conveying chamber 21, the supply conveying chamber 22, and the developer passage paths.

The developing container 20 extends diagonally upward to the right in FIG. 2, and a developing roller 31 is arranged diagonally upward to the right of the supply conveyor screw 25*b* in the developing container 20. Then, a part of the outer peripheral surface of the developing roller 31 is exposed from the opening portion 20*b* of the developing container 20 and faces the photoconductor drum 1*a*. The developing roller 31 rotates in the counterclockwise direction in FIG. 2.

The developing roller 31 includes a cylindrical developing sleeve that rotates in the counterclockwise direction in FIG. 2 and a magnet having a plurality of magnetic poles fixed inside the developing sleeve. Note that here, a developing sleeve, the surface of which has been processed by knurling, is used. However, a developing sleeve with many concave shapes (dimples) formed on the surface or a blasted surface, and furthermore a developing sleeve processed by blasting in addition to knurling and concave shape formation, and a developing sleeve processed by plating treatment may also be used.

Moreover, a regulating blade 27 is attached to the developing container 20 along the longitudinal direction of the developing roller 31 (perpendicular to the paper surface of FIG. 2). A slight gap is formed between the tip-end portion of the regulating blade 27 and the surface of the developing roller 31.

A developing voltage including a DC voltage Vslv (DC) (hereinafter, also referred to as Vdc) and an AC voltage Vslv (AC) is applied to the developing roller 31 by a developing voltage power supply 43 (see FIG. 3).

Figure 3:
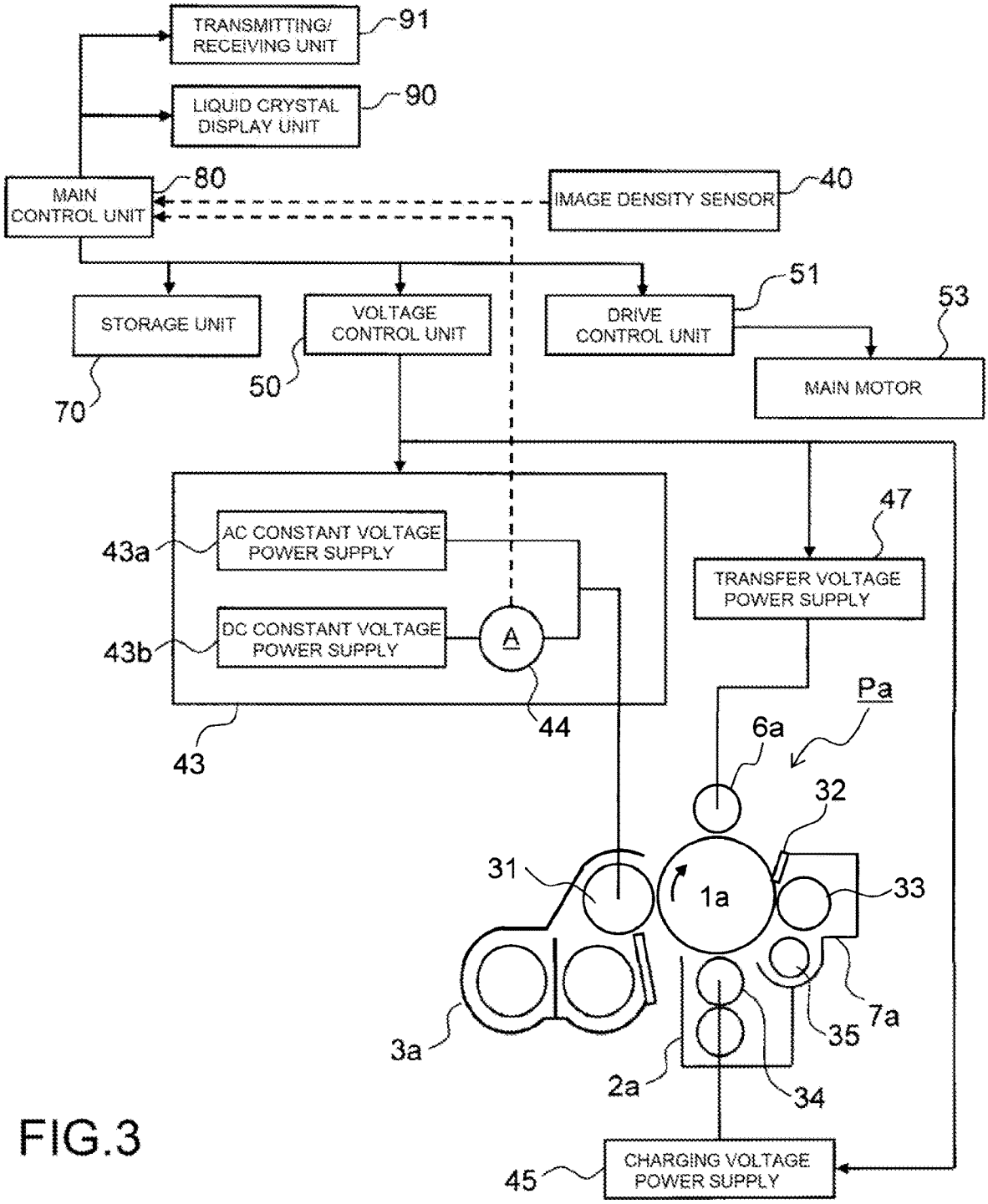
FIG. 3 is a partial enlarged view of the surroundings of an image forming unit Pa including the control path of the developing device 3*a*.

FIG. 3 is a partial enlarged view of the surroundings of an image forming unit Pa including the control path of the developing device 3*a*. In the following description, the configuration of the image forming unit Pa and the control path of the developing device 3*a* will be described; however, the same applies to the configurations of the image forming units Pb to Pd and the control paths of the developing devices 3*b* to 3*d*, and thus the descriptions thereof will be omitted.

The developing roller 31 is connected to the developing voltage power supply 43 that generates an oscillation voltage in which a DC voltage and an AC voltage are superimposed. The developing voltage power supply 43 includes an AC constant voltage power supply 43*a* and a DC constant voltage power supply 43*b*. The AC constant voltage power supply 43*a* outputs a sinusoidal AC voltage generated from a low-voltage DC voltage modulated into a pulse form using a step-up transformer. The DC constant voltage power supply 43*b* outputs a DC voltage obtained by rectifying a sinusoidal AC voltage generated from a low-voltage DC voltage modulated into a pulse form using a step-up transformer.

The developing voltage power supply 43 outputs a developing voltage obtained by superimposing an AC voltage on a DC voltage from the AC constant voltage power supply 43*a* and the DC constant voltage power supply 43*b* at the time of image formation. A current detecting unit 44 detects the DC current value flowing between the developing roller 31 and the photoconductor drum 1*a*.

The charging voltage power supply 45 applies a charging voltage in which an AC voltage is superimposed on a DC voltage to a charging roller 34 of the charging device 2*a*. The configuration of the charging voltage power supply 45 is the same as that of the developing voltage power supply 43. The transfer voltage power supply 47 applies a primary transfer voltage and a secondary transfer voltage to the primary transfer rollers 6*a* to 6*d* and the secondary transfer roller 9 (see FIG. 1), respectively.

The cleaning device 7*a* includes a cleaning blade 32, a rubbing roller 33, and a conveying spiral 35. The cleaning blade 32 removes remaining toner on the surface of the photoconductor drum 1*a*. The rubbing roller 33 removes remaining toner on the surface of the photoconductor drum 1*a* and rubs and polishes the surface of the photoconductor drum 1*a*. The conveying spiral 35 discharges the remaining toner removed from the photoconductor drum 1*a* by the cleaning blade 32 and the rubbing roller 33 to the outside of the cleaning device 7*a*.

Next, the control system of the image forming apparatus 100 will be described with reference to FIG. 3. The image forming apparatus 100 is provided with a main control unit 80 composed of a CPU or the like. The main control unit 80 is connected to a storage unit 70 including a ROM, a RAM, or the like. The main control unit 80 controls each part of the image forming apparatus 100 (charging devices 2*a* to 2*d*, developing devices 3*a* to 3*d*, exposing device 5, primary transfer rollers 6*a* to 6*d*, cleaning devices 7*a* to 7*d*, secondary transfer roller 9, fixing unit. 13, developing voltage power supply 43, the current detecting unit 44, charging voltage power supply 45, transfer voltage power supply 47, voltage control unit 50, drive control unit 51, and the like). This is based on a control program and control data stored in the storage unit 70.

The voltage control unit 50 controls the developing voltage power supply 43 that applies a developing voltage to the developing roller 31, the charging voltage power supply 45 that applies a charging voltage to the charging roller 34, and the transfer voltage power supply 47 that applies a transfer voltage to the primary transfer rollers 6*a* to 6*d* and the secondary transfer roller 9. The drive control unit 51 controls the main motor 53 that rotationally drives the photoconductor drums 1*a* to 1*d*. Note that the voltage control unit 50 and the drive control unit 51 may be configured by a control program stored in the storage unit 70.

A liquid crystal display unit 90 and a transmitting/receiving unit 91 are connected to the main control unit 80. The liquid crystal display unit 90, together with functioning as a touch panel for the user to perform various settings of the image forming apparatus 100, displays the state of the image forming apparatus 100, the image forming status, the number of prints, and the like. The transmitting/receiving unit 91 communicates with the outside using a telephone line or an Internet line.

As described above, when the amount of charge of the toner in the developer changes, problems such as a decrease in image density, image fogging, toner scattering and the like occur. In the image forming apparatus 100 of the present embodiment, the toner current is accurately measured by subtracting the carrier current from the developing current flowing between the developing roller 31 and the photoconductor drums 1*a* to 1*d* at the time of image formation, and the toner charge amount is calculated based on the toner current. Hereinafter, a method for calculating the toner charge amount, which is a feature of the present disclosure, will be described.

The developing current is the sum of the carrier current flowing through the carrier and the toner current flowing due to the movement of the toner. Taking the developing current to be Id [μA], the carrier current to be Ic [μA], and the toner current to be It [μA], the developing current is expressed as Id=Ic+It.

Here, when image formation is performed at a normal processing speed (full-speed mode), the developing current is taken to be Id1, the charge transfer amount is taken to be Qd1, the carrier current is taken to be Id1, the toner current is taken to be It1, the carrier transfer charge amount is taken to be Qc1, and the toner transfer charge amount is taken to be Qt1, and the toner developing amount is taken to be m1. Moreover, when image formation is performed at a processing speed lower than normal (half-speed mode), the developing current is taken to be Id2, the charge transfer amount is taken to be Qd2, the carrier current is taken to be Ic2, the toner current is taken to be It2, the carrier transfer charge amount is taken to be Qc2, the toner transfer charge amount is taken to be Qt2, and the toner developing amount is taken to be m2. In this case, the following Equations (1) and (2) are established.

$$Id1=Ic1+It1 \quad (1)$$

$$Id2=Ic2+It2 \quad (2)$$

Furthermore, the toner charge amount (Q/m) does not change between the full-speed mode and the half-speed mode, so the relationship of Equation (3) is established.

$$Qt1/m1=Qt2/m2 \quad (3)$$

On the other hand, as the processing speed (the linear speed of the photoconductor drums 1*a* to 1*d*) increases, the developing time becomes shorter, so the amount of charge moving through the carrier decreases. In the full-speed mode, the processing speed is twice that of the half-speed mode, so the amount of charge moving through the carriers is halved. In other words, the relationship of Equation (4) is established.

$$Qc1=0.5\times Qc2 \quad (4)$$

Moreover, I (current)=Q (charge)/t (time), so by rewriting the Equations (1) and (2) using Qd and Qc, $$2Qd1=2Qc1+2Qt1 \quad (5)$$

$$Qd2=2Qc1+Qt2 \quad (6)$$

and from Equations (5) and (6)

$$2Qd1-Qd2=2Qt1-Qt2 \quad (7)$$

From Equations (3) and (7)

$$2Qd1-Qd2=2(m1/m2)\times Qt2-Qt2 \quad (8)$$

and from Equation (8), Qt2 is represented by the following Equation (A).

$$Qt2=(2Qd1-Qd2)/\{(2m1-m2)/m2\} \quad (A)$$

Therefore, when Qd1 and Qd2 are calculated from the developing currents Id1 and Id2 detected by the current detecting unit 44, and m1 and m2 are calculated from the image density of the reference image detected by the image density sensor 40, Qt2 may be calculated from the Equation (A). Then, the toner charge amount Qt2/m2 is calculated from the calculated Qt2 and m2.

As described above, the toner charge amount can be calculated accurately by forming a reference image in the full-speed mode and the half-speed mode and measuring the developing currents Id1 and Id2 and the toner developing amounts m1 and m2. Note that although the method of calculating the toner charge amount Qt2/m2 from Qt2 and m2 calculated by the Equation (A) has been described here, an Equation in which Qt2 is eliminated from the Equations (3) and (7) is created, so it is also possible to calculate the toner charge amount Qt1/m1 from Qt1 and m1.

By using the toner charge amount calculated as described above, it is possible to identify the cause of a decrease in the carrier life and the image density. In other words, in a case where it is confirmed that the toner charge amount increases or decreases, the toner may be appropriately supplied to the developing devices 3*a* to 3*d* and consumed, and the developer in the developing devices 3*a* to 3*d* may be appropriately aged. In addition, the deterioration state of the carrier can be known by finding the change over time of the toner charge amount, and by predicting a decrease in the toner charge amount and by changing the target value of the toner density in the developer, or by changing the AC voltage of the developing voltage, it is possible to suppress the generation of development ghosts and transfer memory. Moreover, the timing of the next measurement of the toner charge amount may be optimized in accordance with the prediction of the change over time of the toner charge amount. Furthermore, by adjusting the primary transfer voltage, it is also possible to suppress a decrease in image density due to transfer failure.

A case will also be described in which developing devices 3*a* to 3*d* are used that have a mechanism in which a certain amount of carrier is mixed with the toner in advance, and together with supplying toner containing the carrier according to the consumption of the toner, discharge the excess developer. In this case, when the toner charge amount is significantly reduced, the toner is forcibly ejected to actively replace the carrier in the developing devices 3*a* to 3*d*. Accordingly, it is possible to suppress a decrease in the toner charge amount due to deterioration of the carrier. Furthermore, this may also be used for predicting the replacement time of the developing devices 3*a* to 3*d*.

Figure 4:
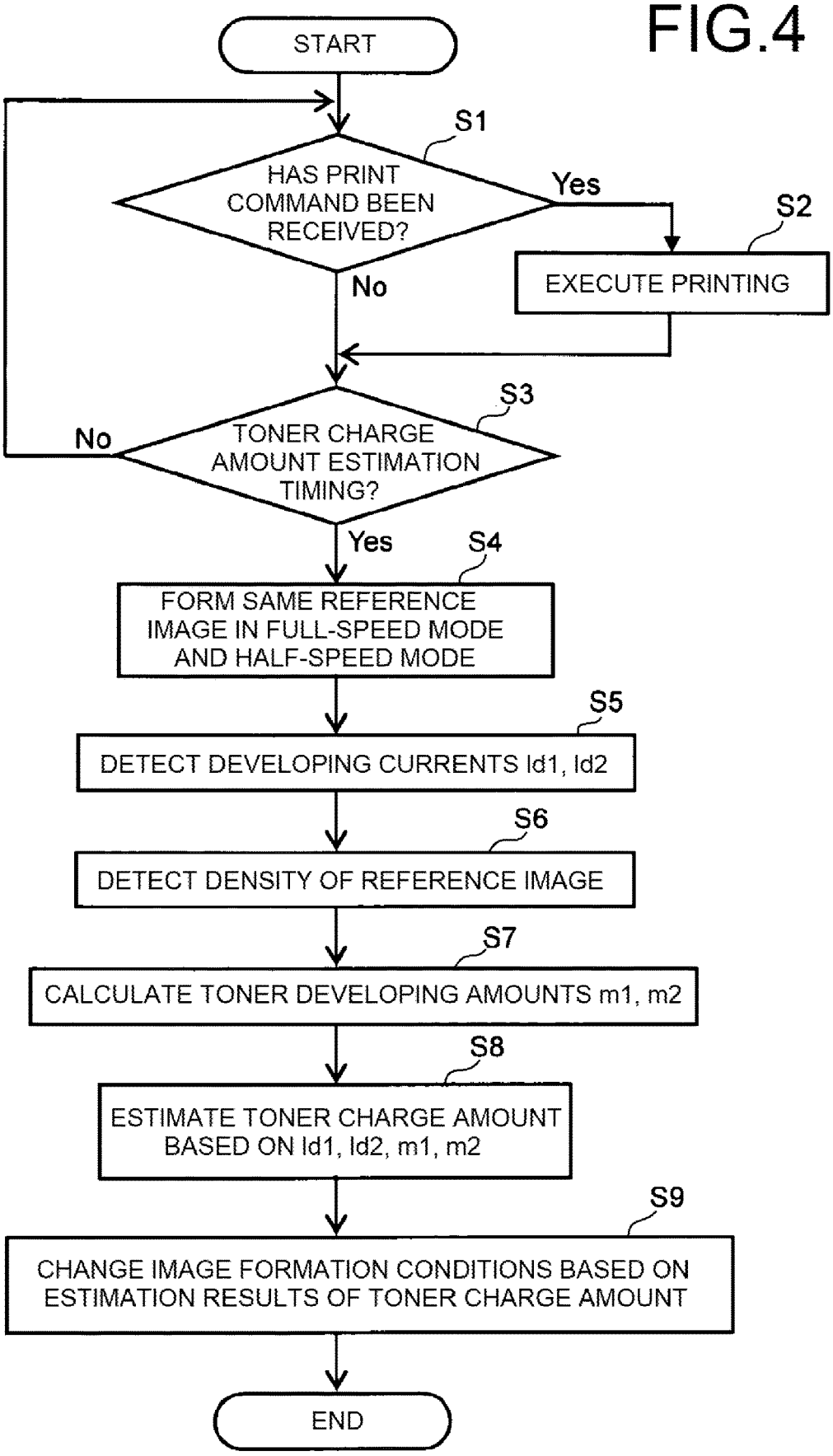
FIG. 4 is a flowchart illustrating an example of estimation control of the toner charge amount in the image forming apparatus 100 of the present embodiment.

FIG. 4 is a flowchart illustrating an example of measurement control of the toner charge amount in the image forming apparatus 100 of the present disclosure. First, the main control unit 80 determines whether or not a print command has been received (step S1). In a case where a print command has been received (YES in step S1), printing is executed by a normal image forming operation (step S2). In a case where a print command is not transmitted (NO in step S1), it is determined whether or not the timing is the timing for estimating the toner charge amount (step S3). Examples of the timing for estimating the toner charge amount include, for example, a case where, at the end of the printing operation, the cumulative number of prints since the previous estimation of the toner charge amount is equal to or greater than a specific number, and the like. In a case where the timing is not the timing for estimating the toner charge amount, the process returns to step S1 and the standby state for a print command is continued.

In a case where the timing is the timing for estimating the toner charge amount (YES in step S3), the estimation mode for estimating the toner charge amount is started. More specifically, after the surfaces of the photoconductor drums 1*a* to 1*d* are charged by the charging devices 2*a* to 2*d*, the exposing device 5 forms electrostatic latent images of a reference image on the photoconductor drums 1*a* to 1*d*. Then, in a state where the photoconductor drums 1*a* to 1*d* are rotationally driven in the full-speed mode and the half-speed mode, the developing voltage power supply 43 applies the developing voltage to the developing roller 31 in order to develop the electrostatic latent images into toner images. As a result, the same reference image is formed on the photoconductor drums 1*a* to 1*d* (step S4). At the same time, the current detecting unit 44 detects the developing currents Id1 and Id2 flowing through the developing roller 31 (step S5).

Next, a specific primary transfer voltage is applied to the primary transfer rollers 6*a* to 6*d* in order to transfer the reference image onto the intermediate transfer belt 8. Then, the density of each reference image is detected by the image density sensor 40 (step S6). The main control unit 80 calculates the toner developing amounts m1 and m2 based on the detected density of the reference image (step S7). The toner developing amounts m1 and m2 are calculated using the relationship between the image density and the toner developing amounts previously stored in the storage unit 70.

Note that, in order to improve the calculation accuracy of the toner developing amounts, it is preferable to increase the number of times the reference image is formed (n number) or change the density of the reference image in a plurality of steps. When changing the density of the reference image, preferably the entire surface of the photoconductor drums 1*a* to 1*d* is exposed by the exposing device 5. At the same time, preferably the potential difference V0−Vdc between the surface potential (potential of the non-exposed portion) V0 of the photoconductor drums 1*a* to 1*d* and the DC component Vdc of the developing voltage applied to the developing roller 31 is kept constant, and V0 and Vdc are changed.

As a result, carrier development at the end portion (edge portion) of the reference image may be suppressed. Furthermore, in a case where a dot-shaped image is formed by changing the printing rate, a high density portion is generated in the dot peripheral portion; however, by exposing the entire surface with the exposing device 5, the high density portion of the dot peripheral portion disappears, so it is possible to reduce error when converting the density of the reference image into the toner development amount.

The main control unit 80 estimates the toner charge amount using the Equation (A) described above based on the developing currents Id1 and Id2 detected in step S5 and the toner developing amounts m1 and m2 calculated in step S7 (step S8).

The main control unit 80 changes the image formation conditions based on the estimation result of the toner charge amount (step S9), and ends the process. Examples of the image formation conditions to be changed include the toner density in the developing devices 3*a* to 3*d*, the Vpp of the AC component of the developing voltage, the potential difference V0−Vdc, the primary transfer voltage applied to the primary transfer rollers 6*a* to 6*d*, and the like.

More specifically, in a case where the toner charge amount is low, it becomes easy for development ghosts to occur, so the toner density is lowered and the toner charge amount is increased. Alternatively, the occurrence of development ghosts is suppressed by lowering Vpp or reducing V0−Vdc. Moreover, in a case where the toner charge amount is low, a decrease in image density due to transfer failure is suppressed by increasing the primary transfer voltage.

Further, a case where the toner charge amount is equal to or lower (or higher) than a fixed value, or in other words, a case where the toner charge amount is outside of a specific range will be described. In this case, an electrostatic latent image pattern (solid pattern) is formed on the photoconductor drums 1*a* to 1*d*, a developing voltage is applied to the developing roller 30, and the toner on the developing roller 31 is transferred to the photoconductor drums 1*a* to 1*d* (forced ejection). In a case where the toner charge amount is equal to or higher than a certain level, it is also effective to lengthen the aging (stirring) time of the developer in the developing devices 3*a* to 3*d*.

Then, the deteriorating state of the toner is displayed on the liquid crystal display unit 90 (see FIG. 3), and a prompt is given to prepare to replace the toner and to change the usage state. Furthermore, in a state where the toner charge amount is significantly reduced, a display requesting toner replacement is displayed on the liquid crystal display unit 90, and the operation of the image forming apparatus 100 is stopped.

According to the control example illustrated in FIG. 4, the same reference image may be formed in the full-speed mode and the half-speed mode, and it is possible to accurately estimate the charge amount of the toner in the developing devices 3*a* to 3*d*. This is based on the developing currents Id1 and Id2 that flow when the reference image is formed, and the toner developing amounts m1 and m2 calculated from the image density of the reference image. Then, by controlling the toner density, the developing voltage, and the transfer voltage in the developing devices 3*a* to 3*d* and by forcibly discharging the toner based on the estimated toner charging amount, image defects such as development ghosts due to the change in the toner charge amount, image fogging, transfer failure and the like may be effectively suppressed.

In addition, the present disclosure is not limited to the above embodiment, and various changes may be made within a range that does not depart from the spirit of the present disclosure. For example, in the embodiment described above, the reference image is formed in the full-speed mode and the half-speed mode, and the toner charge amount is measured based on the relationship between the development amount difference (density difference) of each reference image and the developing current flow when the reference images are formed. However, the processing speed when forming the reference images is not limited to the full-speed mode and the half-speed mode, and the reference images may be formed at other processing speeds as long as the processing speeds are different.

For example, in a case where the reference image is formed in the full-speed mode and the ¾−speed mode, Qt2 (or Qt1) may be calculated by replacing the coefficient of the above-mentioned Equation (4) from 0.5 to 0.75. Furthermore, although two types of processing speeds, full-speed mode and half-speed mode, are used here, reference images may be formed with three or more types of processing speeds.

Moreover, in the embodiment described above, a color printer as illustrated in FIG. 1 has been described as an example of the image forming apparatus 100; however, the present invention is not limited to a color printer, and other image forming apparatuses such as monochrome and color copiers, digital multifunction apparatuses, facsimiles and the like may be used. Hereinafter, the effects of the present disclosure will be described in more detail with reference to Examples.

Examples

Reference images are formed in the full-speed mode and half-speed mode, and a verification test is performed for estimating the toner charge amount in the developing devices 3*a* to 3*d* based on the flowing developing currents Id1 and Id2 and the toner developing amounts m1 and m2 calculated from the image density of the reference images when the reference images are formed. As the conditions of the testing machine, in the image forming apparatus 100 as illustrated in FIG. 1, the photoconductor drums 1*a* to 1*d* having an amorphous silicon (a-Si) photosensitive layer are used, the potential of the non-exposed part is taken to be V0=270V, and the potential of the exposed part is taken to be VL=20V. Moreover, the linear speed of the drums (processing speed) in the full-speed mode is set to 55 sheets/min.

The developing devices 3*a* to 3*d* use a developing roller 31 having a diameter of 20 mm in which 80 rows of recesses are formed in the circumferential direction by knurling, and uses a magnetic blade made of stainless steel (SUS430) is used as the regulating blade 27. The amount of developer conveyed by the developing roller 31 is set to 250 g/m$^2$. The peripheral speed ratio between the developing roller 31 and the photoconductor drums 1*a* to 1*d* is set to 1.8 (trail rotation at the opposite position), and the distance between the developing roller 31 and the photoconductor drums 1*a* to 1*d* is set to 0.30 mm. A voltage obtained by superimposing a rectangular wave AC voltage having a frequency of 4.2 kHz and a Duty=50% onto a 170 V DC voltage Vslv (DC) as a developing voltage is applied to the developing roller 31.

Moreover, a two-component developer composed of a positively charged toner having an average particle diameter of 6.8 μm and a ferrite/resin coat carrier having an average particle diameter of 35 μm is used, and the toner density is set to 8%.

The estimation results of the toner charge amount are listed in Table 1 together with the developing current (Id), the developing charge amount (Qd), the carrier charge amount (Qc), the toner charge amount (Qt), and the toner developing amount (m).

TABLE 1

| MEASUREMENT VALUE (CALCULATION VALUE) | UNIT | FULL-SPEED MODE | HALF-SPEED MODE |
|---|---|---|---|
| DEVELOPING CURRENT (Id) | μA | 8 | 10 |
| DEVELOPING CHARGE AMOUNT (Qd) | μC | 0.461 | 0.576 |
| CARRIER CHARGE AMOUNT (Qc) | μC | 0.077 | 0.154 |
| TONER CHARGE AMOUNT (Qt) | μC | 0.384 | 0.422 |
| TONER DEVELOPING AMOUNT (m) | g | 0.02 | 0.022 |
| TONER CHARGE AMOUNT (Qt/m) | μC/g | 19.2 | 19.2 |

As illustrated in Table 1, in a case of the full-speed mode, the carrier charge amount (Qc) is 0.077 μC, which is half that of the half-speed mode (0.154 μC). The toner charge amount (Qt) is determined by the toner developing amount (m) and the toner charge amount (Qt/m) does not change between the full-speed mode and the half-speed mode, so the carrier charge amount (Qc) and the toner charge amount (Qt) are calculated. Moreover, the toner charge amount (Qt/m) is also calculated from the toner charge amount (Qt) and the toner developing amount (m).

The calculated toner charge amount is 19.2 μC/g in both the full-speed mode and the half-speed mode, which are in good agreement. From the above, it is confirmed that the toner charge amount may be estimated accurately by using this estimation method.

In a method of a typical technique, a surface potential sensor is required to measure the surface potential, which leads to an increase in cost. In addition, in order to acquire the surface potential of the toner layer, it is necessary to install the surface potential sensor on the downstream side of the developing region with respect to the drum rotation direction. However, when the surface potential sensor is installed at this position, the surface of the surface potential sensor becomes easily contaminated with the scattered toner from the developing device, and it becomes impossible to measure the surface potential with high accuracy over a long period of time.

Moreover, in a method of another typical technique, there is a problem that the developing current includes not only the current flowing due to the movement of the toner (toner current) but also the current flowing through the carrier (carrier current). When the carrier current is a constant value, the developing current may be shifted by the amount of the carrier current measured in advance; however, durable printing causes scraping and contamination of the coat layer of the carrier, and the carrier resistance value changes, so the carrier current also changes. As a result, the toner current may not be measured correctly by only measuring the developing current.

In view of the problems described above, an object of the present disclosure is to provide an image forming apparatus capable of measuring a toner current included in a developing current with a simple configuration, and capable of accurately calculating a toner charge amount based on the measurement result.

With a first configuration according to the present disclosure, the image carrier is rotated at two or more different linear speeds to form the same reference image, and the amount of charge of the toner in the developing device may be estimated accurately based on the developing current that flows when the reference image is formed and the toner development amount calculated from the image density of the reference image. Then, by controlling the toner density, developing voltage, and transfer voltage in the developing device and forcibly ejecting the toner based on the estimated toner charge amount, image defects such as development ghosts, image fogging, transfer failure and the like caused by the change in the toner charge amount may be effectively suppressed.

The technique according to the present disclosure may be applied to an image forming apparatus using a two-component developer that includes a toner and a carrier. By utilizing the technique according to the present disclosure, it is possible to provide an image forming apparatus capable of suppressing image defects by accurately estimating the toner charge amount and determining image formation conditions based on the estimation result.

What is claimed is:

1. An image forming apparatus, comprising:

an image forming unit that comprises:

an image carrier having a photosensitive layer formed on the surface thereof;

a charging device that charges the image carrier;

an exposing device that forms an electrostatic latent image by exposing the image carrier charged by the charging device; and a developing device that has a developer carrier arranged facing the image carrier and carrying a two-component developer that includes a magnetic carrier and toner, and forms a toner image by adhering the toner to the electrostatic latent image formed on the image carrier;

a developing voltage power supply that applies a developing voltage obtained by superimposing an AC voltage on a DC voltage on the developer carrier;

a density detecting device that detects a density of the toner image formed by the developing device;

a current detecting unit that detects a DC component of a developing current that flows when the developing voltage is applied to the developer carrier; and a control unit that controls the image forming unit and the developing voltage power supply;

the control unit, in a state in which the image carrier is rotated at two or more different linear speeds during non-image formation, forms a same reference image on the image carrier by the developing device, and estimates the toner charge amount based on the developing current when the reference image is formed and the density of the reference image detected by the density detection device;

wherein the control unit, by the current detecting unit, detects developing currents Id1, Id2 when the reference image is formed at a first linear speed and a second linear speed that is ½ of the first linear speed;

from the detected Id1, Id2, calculates developing charge amounts Qd1, Qd2 when the reference image is formed at the first linear speed and the second linear speed;

from an image density of the reference image detected by the density detecting device, calculates toner development amounts m1, m2 when the reference image is formed at the first linear speed and the second linear speed;

from the calculated Qd1, Qd2, m1, and m2 and using Equation (A)

$$Qt2=(2Qd1-Qd2)/\{(2m1-m2)/m2\} \quad \text{(A)}$$

calculates a toner charge amount Qt2 when the reference image is formed at the second linear speed; and from the calculated Qt2 and m2, calculates a toner charge amount Qt2/m2.

2. The image forming apparatus according to claim 1, wherein the control unit changes image formation conditions based on the estimated toner charge amount.

3. The image forming apparatus according to claim 2, wherein when the toner charge amount is lower than a specific value, the control unit lowers a toner density in the developing device, or lowers Vpp of an AC component of the developing voltage, or reduces a potential difference V0−Vdc between a surface potential V0 of the image carrier and a DC component Vdc of the developing voltage.

4. The image forming apparatus according to claim 2, further comprising a transfer member that is arranged facing the image carrier and that transfers the toner image formed on the image carrier to a subject to transfer; wherein when the toner charge amount is lower than a specific value, the control unit increases a transfer voltage applied to the transfer member.

5. The image forming apparatus according to claim 1, wherein when an estimated toner charge amount is outside of a specified range, the control unit performs a forced ejection operation for ejecting the toner inside the developing device to the image carrier.

* * * * *